US008105013B2

(12) United States Patent
Stones

(10) Patent No.: US 8,105,013 B2
(45) Date of Patent: Jan. 31, 2012

(54) VACUUM PUMP

(75) Inventor: Ian David Stones, Burgess Hill (GB)

(73) Assignee: Edwards Limited, Crawley, West Sussex (GB)

( * ) Notice: Subject to any disclaimer, the term of this patent is extended or adjusted under 35 U.S.C. 154(b) by 1045 days.

(21) Appl. No.: 11/883,968

(22) PCT Filed: Jan. 9, 2006

(86) PCT No.: PCT/GB2006/000067

§ 371 (c)(1),
(2), (4) Date: Aug. 7, 2007

(87) PCT Pub. No.: WO2006/090103

PCT Pub. Date: Aug. 31, 2006

(65) Prior Publication Data

US 2008/0145205 A1 Jun. 19, 2008

(30) Foreign Application Priority Data

Feb. 25, 2005 (GB) ..... 0503946.6

(51) Int. Cl.
*F04D 29/18* (2006.01)

(52) U.S. Cl. ..... 415/116; 415/90; 415/199.5; 415/72; 416/176; 416/198 A

(58) Field of Classification Search ..... 415/90, 415/116, 71, 199.5; 416/176, 198 A; 417/423.4
See application file for complete search history.

(56) References Cited

U.S. PATENT DOCUMENTS

| | | | | |
|---|---|---|---|---|
| 4,732,529 | A * | 3/1988 | Narita et al. | 415/90 |
| 4,978,276 | A | 12/1990 | Kabelitz et al. | |
| 5,052,887 | A * | 10/1991 | Novikov et al. | 415/90 |
| 5,553,998 | A * | 9/1996 | Muhlhoff et al. | 415/90 |
| 5,733,104 | A | 3/1998 | Conrad et al. | |
| 6,106,223 | A * | 8/2000 | Leyshon | 415/90 |
| 6,435,811 | B1 | 8/2002 | Beyer et al. | |
| 6,514,035 | B2 * | 2/2003 | Iwane et al. | 415/72 |
| 2002/0025249 | A1 | 2/2002 | Iwane | |

FOREIGN PATENT DOCUMENTS

| | | | |
|---|---|---|---|
| EP | 0 530 462 | A1 | 3/1993 |
| EP | 1 302 667 | A1 | 4/2003 |
| GB | 2 360 066 | A | 9/2001 |
| WO | WO 2004/068099 | A1 | 8/2004 |
| WO | WO 2005/033521 | A1 | 4/2005 |

OTHER PUBLICATIONS

United Kingdom Search Report of Application No. GB 0503946.6; Claims searched: 1-15; Date of search: Jun. 27, 2005.

(Continued)

*Primary Examiner* — Ninh H Nguyen

(57) ABSTRACT

A vacuum pump comprises a first pumping section 106, and, downstream therefrom, a second pumping section 108. The pump comprises a first pump inlet 120 through which fluid can enter the pump and pass through both the first and second pumping sections towards a pump outlet, and a second pump inlet 122 through which fluid can enter the pump and pass through only the second pumping section towards the outlet. The second pumping section 108 comprises at least one turbo-molecular pumping stage 109*a*, 109*b* and, downstream therefrom, an externally threaded rotor 109*c*.

14 Claims, 4 Drawing Sheets

OTHER PUBLICATIONS

PCT Notification of Transmittal of the International Search Report and the Written Opinion of the International Searching Authority, or the Declaration of International Application No. PCT/GB2006/000067; Date of mailing: Mar. 27, 2006.

PCT International Search Report of International Application No. PCT/GB2006/000067; Date of Search: Mar. 27, 2006.

PCT Written Opinion of the International Searching Authority of International Application No. PCT/GB2006/000067; Date of mailing: Mar. 27, 2006.

* cited by examiner

VACUUM PUMP

FIELD OF THE INVENTION

This invention relates to a vacuum pump and in particular a compound vacuum pump with multiple ports suitable for differential pumping of multiple chambers.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first and second evacuated interface chambers 12, 14. The first interface chamber 12 is the highest-pressure chamber in the evacuated spectrometer system and may contain an orifice or capillary through which ions are drawn from the ion source into the first interface chamber 12. The second, interface chamber 14 may include ion optics for guiding ions from the first interface chamber 12 into the high vacuum chamber 10. In this example, in use, the first interface chamber 12 is at a pressure of around 1 mbar, the second interface chamber 14 is at a pressure of around $10^{-2}$ to $10^{-3}$ mbar, and the high vacuum chamber 10 is at a pressure of around $10^{-5}$ mbar.

The high vacuum chamber 10 and second interface chamber 14 can be evacuated by means of a compound vacuum pump 16. In this example, the vacuum pump has a first pumping section 18 and a second pumping section 20 each in the form of a set of turbo-molecular stages, and a third pumping section in the form of a Holweck drag mechanism 22; an alternative form of drag mechanism, such as a Siegbahn or Gaede mechanism, could be used instead. Each set of turbomolecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets of turbo-molecular stages in sequence and the Holweck mechanism 22 and exits the pump via outlet 30. A second pump inlet 26 is connected to the second interface chamber 14, and fluid pumped through the inlet 26 passes through one set of turbo-molecular stages and the Holweck mechanism 22 and exits the pump via outlet 30. In this example, the first interface chamber 12 may be connected to a backing pump (not shown), which may also pump fluid from the outlet 30 of the compound vacuum pump 16. As fluid entering each pump inlet passes through a respective different number of stages before exiting from the pump, the pump 16 is able to provide the required vacuum levels in the chambers 10, 14.

In some such applications, a Holweck mechanism such as that illustrated in FIG. 1 typically provides a backing pressure to the second pumping section 20 of around 0.01 mbar to 0.1 mbar. The use of turbomolecular stages for a pumping section having such a relatively high backing pressure to produce an inlet pressure of above $10^{-3}$ mbar may cause excessive heat generation within the pump and severe performance loss, and may even be detrimental to the pump reliability. In view of this, our co-pending International patent application PCT/GB2004/004114, the contents of which are hereby incorporated by reference, describes a compound vacuum pump in which the second pumping section 20 is provided by an externally threaded, or helical, rotor. Such a compound vacuum pump 40 is illustrated in FIG. 2, in which the helical rotor is indicated at 42. In such a pump, the inlet of the helix of the helical rotor will behave in use like a rotor of a turbomolecular stage, and thus provide a pumping action through both axial and radial interactions. As discussed in the above-referenced co-pending application, an advantage of the use of such a deep groove helical rotor in place of the set of turbomolecular stages is that it can offer a comparable pumping capacity, but with lower levels of power consumption and heat generation.

It is an aim of at least the preferred embodiment of the present invention to further improve the performance of a differential pumping, multi port, compound vacuum pump that includes a pumping section comprising a helical rotor.

SUMMARY OF THE INVENTION

The present invention provides a vacuum pump comprising a first pumping section, a second pumping section downstream from the first pumping section, a third pumping section downstream from the second pumping section, a first pump inlet through which fluid can enter the pump and pass through each of the pumping sections towards a pump outlet, and a second pump inlet through which fluid can enter the pump and pass through only the second and the third pumping sections towards the outlet, wherein the third pumping section comprises a helical groove formed in a stator thereof, and at least one of the first and second pumping sections comprises at least one turbo-molecular stage and, downstream therefrom, a rotor comprising a helical groove.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
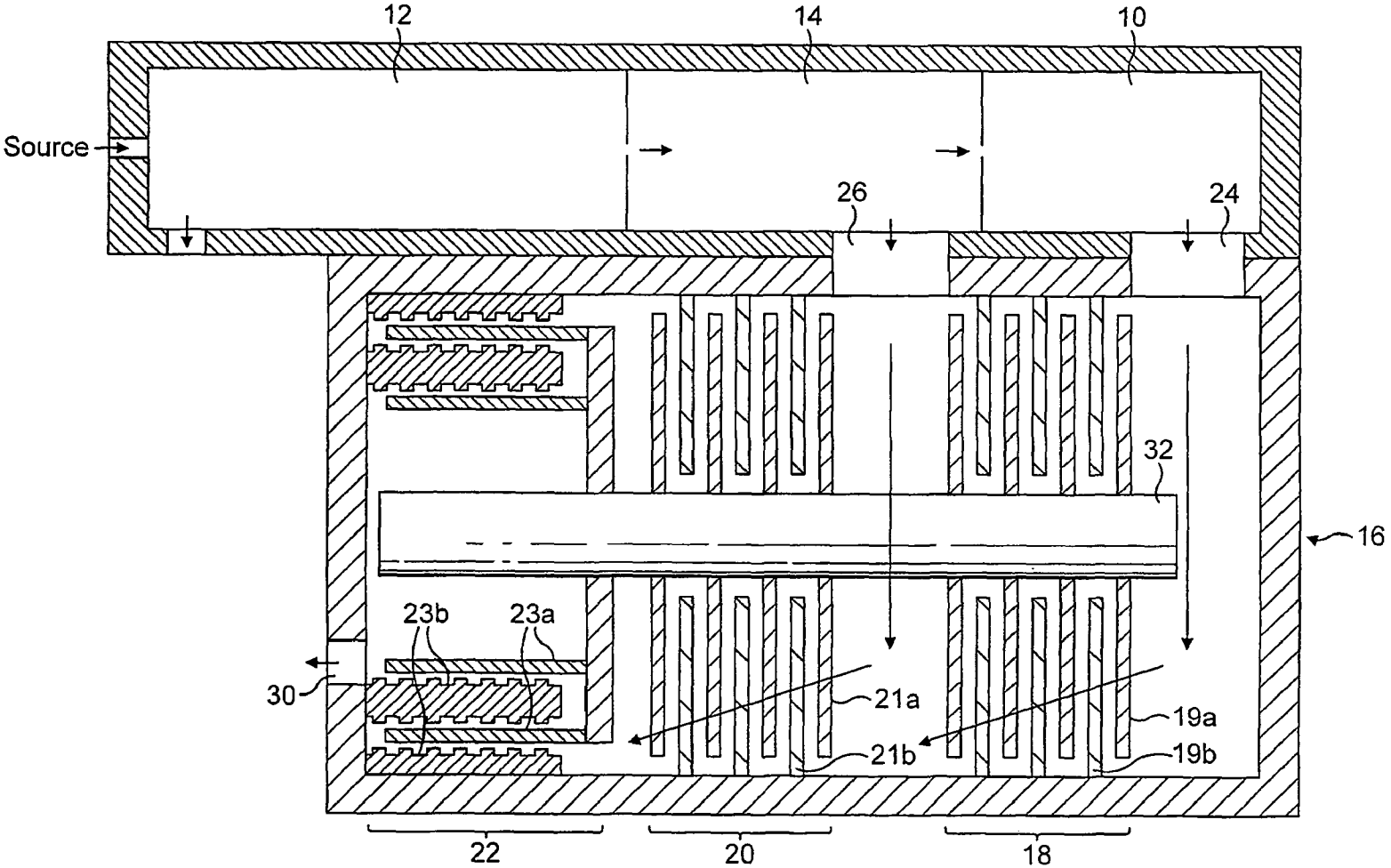
FIG. 1 (PRIOR ART)
FIG. 1 is a simplified cross-section through a known multi port vacuum pump suitable for evacuating a differentially pumped, mass spectrometer system.
Figure 2:
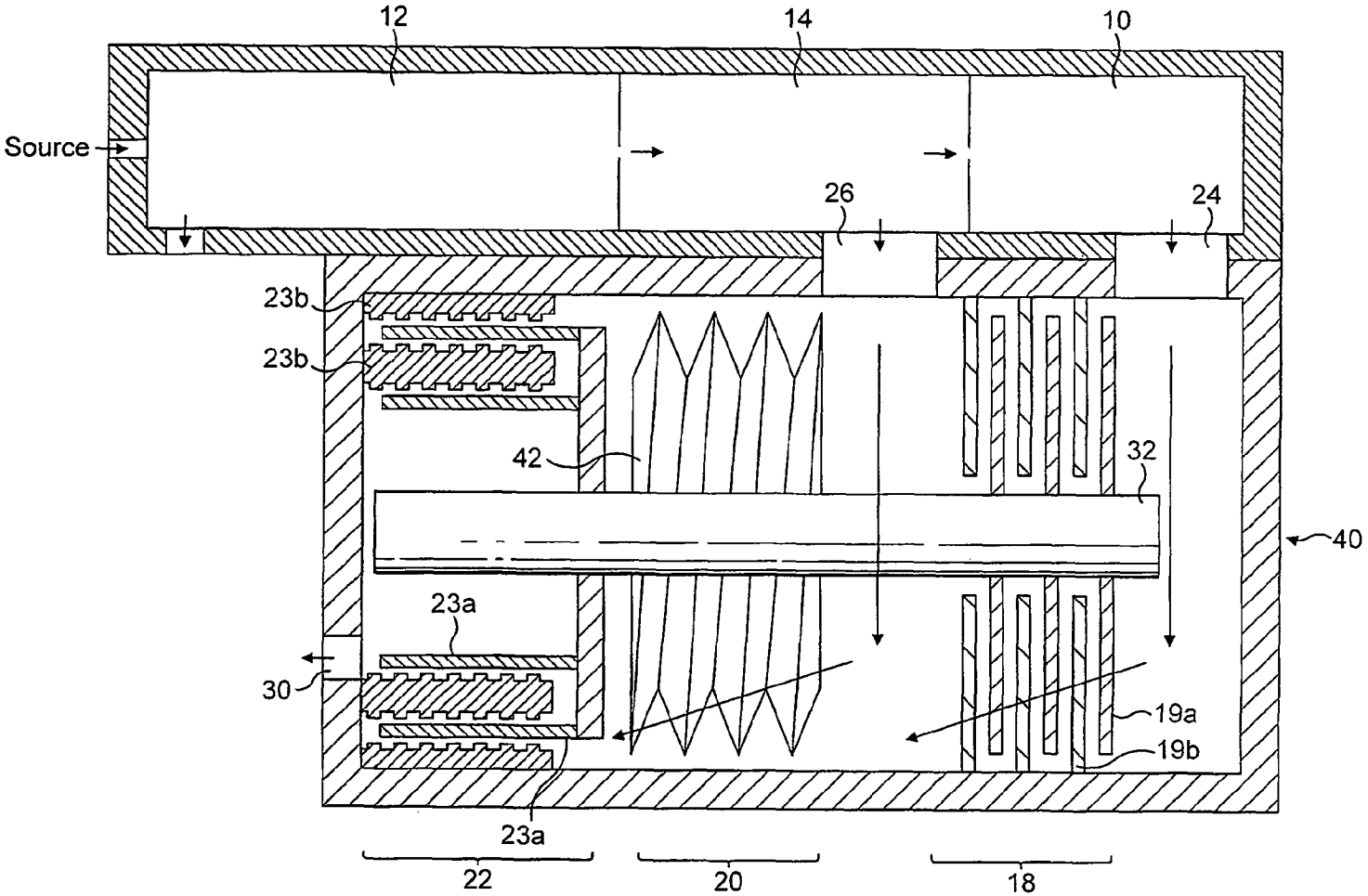
FIG. 2 is a simplified cross-section through a multi port vacuum pump described in International patent application PCT/GB2004/004114.

In a first aspect, the present invention provides a vacuum pump comprising a first pumping section, a second pumping section downstream from the first pumping section, a third pumping section downstream from the second pumping section, a first pump inlet through which fluid can enter the pump and pass through each of the pumping sections towards a pump outlet, and a second pump inlet through which fluid can enter the pump and pass through only the second and the third pumping sections towards the outlet, wherein the third pumping section comprises a helical groove formed in a stator thereof, and at least one of the first and second pumping sections comprises at least one turbo-molecular stage and, downstream therefrom, a rotor comprising a helical groove.

Thus, the second, wholly turbo-molecular pumping section 20, for example, of the known pump described with reference to FIG. 1 can be effectively replaced by a pumping section having both at least one turbomolecular pumping stage and, downstream therefrom, an externally threaded, or helical, rotor. In such an arrangement, the inlet of the helix will behave in use like a rotor of a turbo-molecular stage, and thus provide a pumping action through both axial and radial interactions. In comparison, a Holweck mechanism with a static thread, such as that indicated at 22 in FIG. 1, pumps fluid by nominally radial interactions between the thread and cylinder. Beyond a certain radial depth of thread, this mechanism becomes less efficient due to the reducing number of radial interactions, and it is for this reason that the typical capacity of a "static" Holweck mechanism is limited to less than that of an equivalent diameter turbo-molecular stage, which pumps by nominally axial interactions and has greater radial blade depths. By providing an externally threaded rotor, the inlet of the thread of the externally threaded rotor can be made much deeper radially than the helical groove in a static Holweck mechanism, resulting in a significantly higher pumping capacity. As used herein, the terms 'rotating' and 'static' with relation to the Holweck mechanism and its mounting refer to the frame of reference of the gas. That is to say that a 'static Holweck mechanism' defines a Holweck mechanism that is not rotating relative to the average direction of travel of gas molecules at the inlet or outlet. Similarly, a 'rotating Holweck mechanism' defines a Holweck mechanism that is rotating relative to the average direction of travel of gas molecules at the inlet or outlet.

As discussed in co-pending International patent application PCT/GB2004/004114, the contents of which is hereby incorporated by reference, an advantage of using a deep groove helical rotor in place of a set of turbomolecular stages is that it can offer a comparable pumping capacity at higher inlet pressures (above $10^{-3}$ mbar) with lower levels of power consumption / heat generation. By adding at least one turbomolecular stage, preferably only one or two turbo-molecular pumping stages in order to minimise the length of the pump, in front of, or upstream from, the helical rotor, the helical rotor serves to reduce the backing pressure experienced by these turbo-molecular stage(s). As a result, the pumping capacity of the second pumping stage can be further improved without increasing the power consumption of the pump above that of the pump illustrated in FIG. 1.

Minimising the increase in pump size/length while increasing the system performance where required can make the pump particularly suitable for use as a compound pump for use in differentially pumping multiple chambers of a bench-top mass spectrometer system requiring a greater mass flow rate at, for example, the middle chamber to increase the sample flow rate into the analyser with a minimal or no increase in pump size.

To ensure that fluid enters the helical rotor with maximum relative velocity to the helix blades, and thereby optimise pumping performance, said at least one turbo-molecular stage is preferably arranged such that the molecules of fluid entering the helical rotor have been emitted from the surface of a stator of said at least one turbomolecular stage by placing a stator stage as the final stage of said at least one turbomolecular section adjacent the inlet side of the helical rotor.

As the molecules transfer from the inlet side of the rotor towards the outlet side, the pumping action is similar to that of a static Holweck mechanism, and is due to radial interactions between rotating and stationary elements. Therefore, the helical rotor preferably has a tapering thread depth from inlet to outlet (preferably deeper at the inlet side than at the outlet side). Furthermore, the helical rotor preferably has a different helix angle at the inlet side than at the outlet side; both the thread depth and helix angle are preferably reduced smoothly along the axial length of the pumping section from the inlet side towards the outlet side.

In a preferred arrangement, the first pumping section comprises at least one turbo-molecular stage, preferably at least three turbo-molecular stages. The first and second pumping sections may be of a different size/diameter. This can offer selective pumping performance.

The third pumping section preferably comprises a molecular drag pumping mechanism, for example a Holweck pumping mechanism comprising one or more pumping stages. As is well known, such a pumping mechanism typically comprises a cylindrical rotor and a stator having formed therein a helical groove. Offering static surfaces adjacent to the outlet of the helical rotor stage, by providing a third pumping section having a helical groove formed in a stator thereof, can further optimise pump performance.

The invention also provides a differentially pumped vacuum system comprising two chambers and a pump as aforementioned for evacuating each of the chambers. One of the pumping sections arranged to pump fluid from a chamber in which a pressure above $10^{-3}$ mbar, more preferably above $5\times10^{-3}$ mbar, is to be generated preferably comprises an externally threaded rotor.

Figure 3:
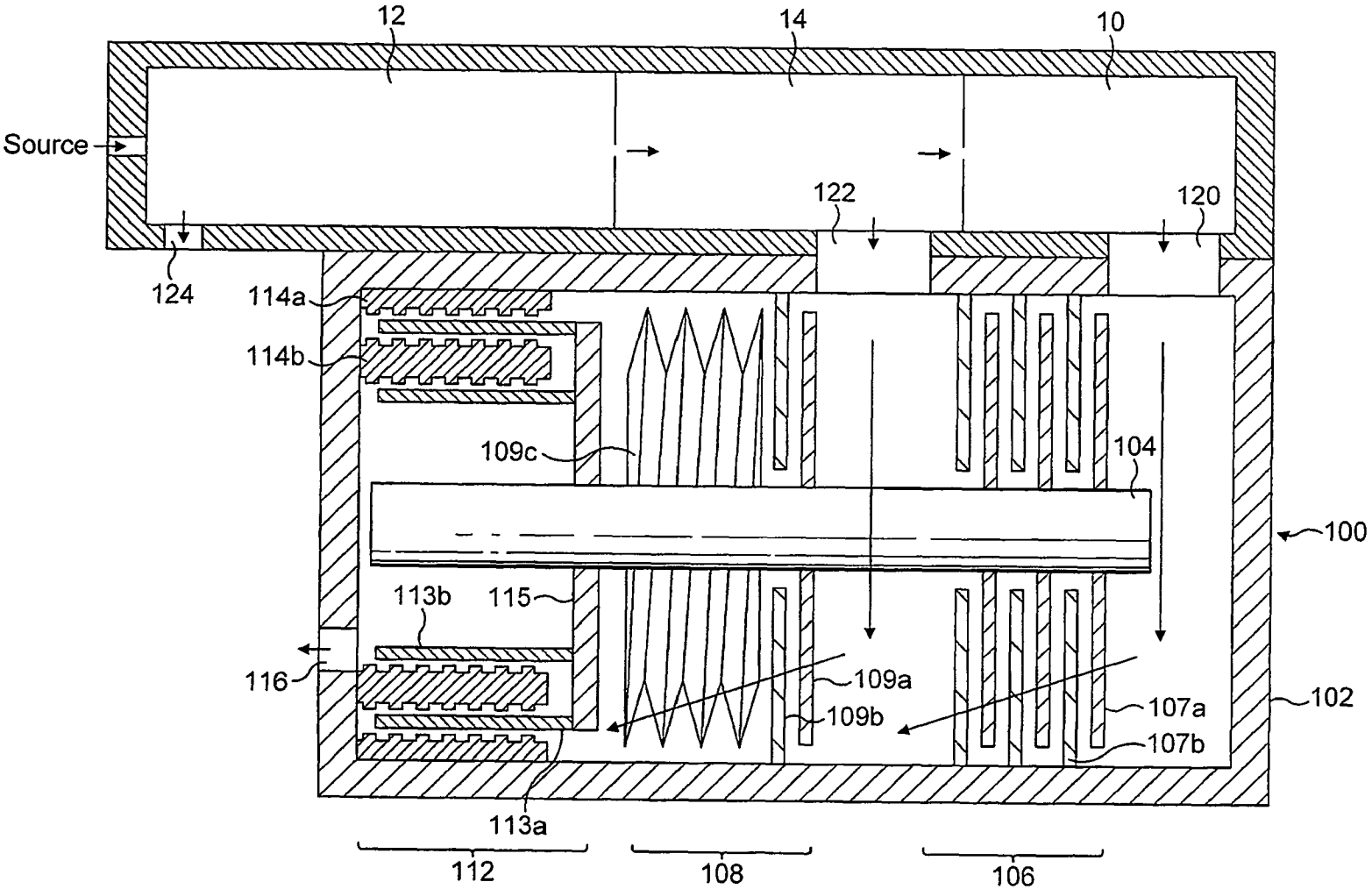
FIG. 3 is a simplified cross-section through an embodiment of a multi port vacuum pump suitable for evacuating the differentially pumped mass spectrometer system of FIG. 1.

With reference to FIG. 3, an embodiment of a vacuum pump 100 suitable for evacuating at the least the high vacuum chamber 10 and intermediate chamber 14 of the differentially pumped mass spectrometer system described above with reference to FIG. 1 comprises a multi-component body 102 within which is mounted a shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes three pumping sections 106, 108 and 112. The first pumping section 106 comprises a set of turbo-molecular stages. In the embodiment shown in FIG. 3, the set of turbo-molecular stages 106 comprises four rotor blades and three stator blades of known angled construction. A rotor blade is indicated at 107*a* and a stator blade is indicated at 107*b*. In this example, the rotor blades 107*a* are mounted on the drive shaft 104.

Figure 4:
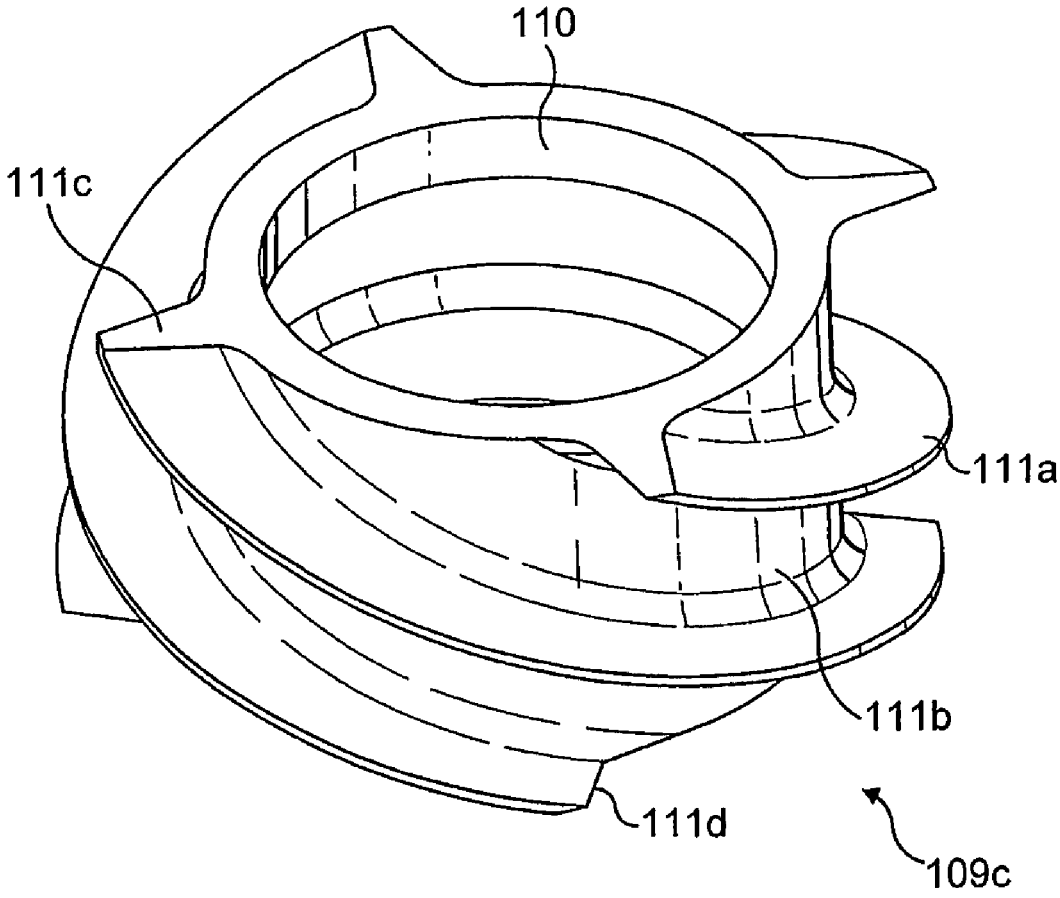
FIG. 4 illustrates an externally threaded rotor of the pump of FIG. 3.

The second pumping section 108 comprises at least one turbo-molecular stage 109*a*, 109*b* and, downstream therefrom, an externally threaded rotor 109*c*. In the illustrated embodiment, the second pumping section comprises a single turbo-molecular stage, although two or more turbo-molecular pumping stages may be provided as required. The turbo-molecular stage comprises a rotor blade 109*a* and a stator blade 109*b* adjacent the externally threaded rotor 109*c*. The externally threaded rotor is shown in more detail in FIG. 4. This rotor 109*c* comprises a bore 110 through which passes the drive shaft 104, and an external thread 111*a* defining a helical groove 111*b*. The depth of the thread 111*a*, and thus the depth of the groove 111*b*, can be designed to taper from the inlet side 111*c* of the rotor 109 towards the outlet side 111*d*. In this embodiment, the thread 111*a* is deeper at the inlet side than at the outlet side, although this is not essential. The helix angle, namely the angle of inclination of the thread to a plane perpendicular to the axis of the shaft 104, of the rotor can also vary from the inlet side to the outlet side; in this embodiment, the helix angle is shallower at the outlet side than at the inlet side, although again this is not essential.

As shown in FIG. 3, downstream of the first and second pumping sections is a third pumping section 112 in the form of a Holweck or other type of drag mechanism. In this embodiment, the Holweck mechanism comprises two rotating cylinders 113*a*, 113*b* and corresponding annular stators 114*a*, 114*b* having helical channels formed therein in a manner known per se. The rotating cylinders 113*a*, 113*b* are preferably formed from a carbon fibre material, and are mounted on a disc 115, which is located on the drive shaft 104. In this example, the disc 115 is also mounted on the drive shaft 104. Downstream of the Holweck mechanism 112 is a pump outlet 116.

As an alternative to individually mounting the rotary elements 107*a*, 109*a*, 109*c* and 115 on the drive shaft 104, one or more these elements may be located on, preferably integral with, a common impeller mounted on the drive shaft 104, with the carbon fibre rotating cylinders 113*a*, 113*b* of the Holweck mechanism 112 being mounted on the rotating disc 115 following machining of these integral rotary elements.

As illustrated in FIG. 3, the pump 100 has two inlets; although only two inlets are used in this embodiment, the pump may have three or more inlets, which can be selectively opened and closed and can, for example, make the use of internal baffles to guide different flow streams to particular portions of a mechanism. The first, low fluid pressure inlet 120 is located upstream of all of the pumping sections. The second, high fluid pressure inlet 122 is located interstage the first pumping section 106 and the second pumping section 108.

In use, each inlet is connected to a respective chamber of the differentially pumped mass spectrometer system. Fluid passing through the first inlet 120 from the low pressure chamber 10 passes through each of the pumping sections 106, 108, 112 and exits the pump 100 via pump outlet 116. To ensure that fluid enters the helical rotor 109*c* of the second pumping stage 108 with maximum relative velocity to the helix blades (threads), and thereby optimise pumping performance, as illustrated the turbo-molecular stage(s) of the second pumping section 108 is preferably arranged such that the molecules of fluid entering the helical rotor 109 have been emitted from the surface of a stator 109*b* of that stage, and the subsequent stage of the Holweck mechanism 112 is also preferably stationary to offer static surfaces at the outlet side 111*d* of the rotor 109.

Fluid passing through the second inlet 122 from the middle pressure chamber 14 enters the pump 100 and passes through pumping sections 108, 112 only and exits the pump via outlet 116. Fluid passing through a third inlet 124 from the high pressure chamber 12 may be pumped by a backing pump (not shown) which also backs the pump 100 via outlet 116.

In this embodiment, in use, the first interface chamber 12 is at a pressure of around 1 mbar, the second interface chamber 14 is at a pressure of around $10^{-2}$-$10^{-3}$ mbar, and the high vacuum chamber 10 is at a pressure of around $10^{-5}$ mbar. Thus, in comparison to the example illustrated in FIG. 1, the pressure in the second interface chamber 14 can be increased in the embodiment shown in FIG. 3. By increasing the pressure from around $10^{-3}$ mbar to around $10^{-2}$ mbar, the requirements on pumping speed are reduced by the ratio of the old to the new pressure for a fixed flow. Therefore, for example, if the pressure is raised ten-fold, and the flow rate is doubled, the pumping speed at this new pressure can be reduced 5-fold, although in use it would clearly be beneficial to maintain as high a pumping speed as possible to maximise the flow rate from the second interface chamber 14. A turbo-molecular pumping section such as that indicated at 20 in FIG. 1 would not be as effective as the pumping section 108 in FIG. 3 at maintaining a pressure of around $10^{-2}$ mbar in the second interface chamber 14, and would in use consume more power, generating more heat than pumping section 108 and potentially have less performance due to operating further outside its effective performance range.

Thus, a particular advantage of the embodiment described above is that the mass flow rate of fluid entering the pump from the middle chamber 14 can be at least doubled in comparison to the known arrangement shown in FIG. 1 without any increase in the size of the pump. In view of this, the flow rate of the sample-entering the high vacuum chamber 10 from the middle chamber can also be increased, increasing the performance of the differentially pumped mass spectrometer system.

While the foregoing description and drawings represent the preferred embodiments of the present invention, it will be apparent to those skilled in the art that various changes and modifications may be made therein without departing from the true spirit and scope of the present invention.

I claim:

1. A vacuum pump comprising a first pumping section, a second pumping section downstream from the first pumping section, a third pumping section downstream from the second pumping section, a first pump inlet through which fluid can enter the pump and pass through each of the pumping sections towards a pump outlet, and a second pump inlet through which fluid can enter the pump and pass through only the second and the third pumping sections towards the outlet, wherein the third pumping section comprises a helical groove formed in a stator thereof, and at least one of the first and second pumping sections comprises at least one turbo-molecular stage and, downstream therefrom, a rotor comprising a helical groove, wherein the depth of the groove at the inlet side of the rotor is greater than the depth of the groove at the inlet side of the stator.

2. The pump according to claim 1 wherein the depth of the helical groove on the rotor varies from the inlet side thereof to the outlet side thereof.

3. The pump according to claim 1 wherein the depth of the helical groove on the rotor decreases from the inlet side thereof to the outlet side thereof.

4. The pump according to claim 1 wherein the inclination of the helical groove on the rotor varies from the inlet side thereof to the outlet side thereof.

5. The pump according to claim 1 wherein the inclination of the helical groove on the rotor decreases from the inlet side thereof to the outlet side thereof.

6. The pump according to claim 1 wherein the second pumping section comprises said rotor and said at least one turbo-molecular stage.

7. The pump according to claim 6 wherein the first pumping section comprises at least one turbo-molecular stage.

8. The pump according to claim 7 wherein the first pumping section comprises at least three turbo-molecular stages.

9. The pump according to claim 1 wherein both the first and second pumping sections are axially displaced relative to the first and second inlets.

10. The pump according to claim 1 wherein the third pumping section comprises a molecular drag pumping mechanism.

11. The pump according to claim 10 wherein the molecular drag pumping mechanism comprises a Holweck pumping mechanism.

12. A differentially pumped vacuum system comprising two chambers and further comprising a vacuum pump according to claim 1 for evacuating each of the two chambers.

13. The system according to claim 12 wherein one of the first pumping section, second pumping station and third pumping section is arranged to pump fluid from one of the two chambers in which a pressure of above $10^{-3}$ mbar is to be generated comprises an externally threaded rotor.

14. The system according to claim 12 wherein one of the pumping stages is arranged to pump fluid from one of the two chambers in which a pressure of above $5\times10^{-3}$ mbar is to be generated comprises an externally threaded rotor.

* * * * *